US005776669A

United States Patent [19]

Crawley et al.

[11] Patent Number: 5,776,669

[45] Date of Patent: Jul. 7, 1998

[54] PHENOL SUBSTITUTED PYRAZOLO 1, 5-A BENZIMIDAZOLE COUPLERS

[75] Inventors: Michael William Crawley, Kingswood; Andrew William Gibson, Woodhead; Hugh Martin Williamson, Hanwell, all of United Kingdom

[73] Assignee: Eastman Kodak Company, Rochester, N.Y.

[21] Appl. No.: 798,673

[22] Filed: Feb. 11, 1997

Related U.S. Application Data

[63] Continuation of Ser. No. 557,673, Nov. 13, 1995, abandoned, which is a continuation of Ser. No. 996,234, Dec. 23, 1992, abandoned which is a continuation of PCT/EP91/01126, Jun. 17, 1991.

[30] Foreign Application Priority Data

Jun. 28, 1990 [GB] United Kingdom ..... 9014435

[51] Int. Cl.[6] ..... G03C 1/08; G03C 7/26; G03C 7/32

[52] U.S. Cl. ..... 430/558

[58] Field of Search ..... 430/558

[56] References Cited

U.S. PATENT DOCUMENTS 5,143,821 9/1992 Crawley et al. ..... 430/558

FOREIGN PATENT DOCUMENTS 0491317 6/1992 European Pat. Off. .
1018949 1/1986 Japan .
2196662 8/1987 Japan .

OTHER PUBLICATIONS

English Translation of J62/196662, Aug. 1987, Japan.

*Primary Examiner*—Geraldine Letscher
*Attorney, Agent, or Firm*—Arthur E. Kluegel

[57] ABSTRACT

The invention provides a pyrazolo[1,5-a]benzimidazole compound of the formula (I)

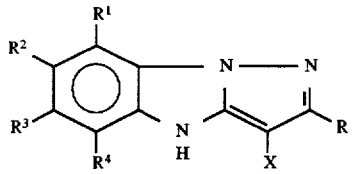

(I)

wherein R to $R^4$ are selected from H, substituted or unsubstituted alkoxy, anilino, aryl, alkyl or amido groups, and X is H or a coupling-off group; characterized in that said compound of Formula I is linked via any of the moieties R to $R^4$ or X to a compound of the formula (II):

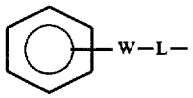

(II)

wherein W is an electron withdrawing group and L is a linking group.

Compounds with the low pKa phenolic substituent provide improved coupling activity when used with a photographic element and improved contrast.

10 Claims, No Drawings

PHENOL SUBSTITUTED PYRAZOLO 1, 5-A BENZIMIDAZOLE COUPLERS

This application in a continuation of U.S. Ser. No. 08/557,673 filed Nov. 13, 1995, now abandoned, which is a continuation of U.S. Ser. No. 07/996,234 filed Dec. 23, 1992, now abandoned, which is a continuation of PCT International Application PCT/EP91/01126 filed Jun. 17, 1991.

The present invention relates to phenol substituted pyrazolo[1,5-a]benzimidazole couplers, for colour photography, particularly those containing a low pKa phenolic substituent.

This invention relates particularly to colour photography and is particularly useful in magenta and cyan colour couplers used in silver halide imaging systems where dyes are formed by oxidative coupling within the photographic layer.

Pyrazolo benzimidazole couplers for magenta and cyan silver halide imaging systems are known in the art. Earlier disclosures have been predominantly concerned with a use as magenta couplers and mainly relate to 2-alkyl derivatives and to a lesser extent the 2-anilino and 2-amido derivatives.

This technology has recently been taken further by utilizing pyrazolobenzimidazoles containing electron withdrawing substitutents as cyan couplers. Examples of such disclosures are JP 63/281161-A (Konishiroku), EP-A-287265 (Konishiroku) and EP-A-271063 (Fuji).

Further GB-A-1,047,612 reveals pyrazolo-[1,5-a]-benzimidazole couplers of the formula:

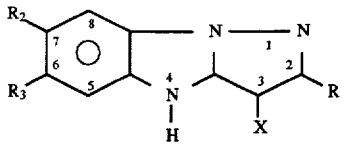

wherein

R=$C_1$ to $_{20}$ alkyl, aryl, carbonyl, carboalkoxy, carboamido or substituted carboamido, X=halo or sulpho, $R_2$=halo, alkoxy, carboamido, substituted carboamido carbonyl, carboalkyl with 1 to 18 carbon atoms in the alkyl group, and $R_3$ is optionally halo.

We now find that the performance of such compounds can be significantly improved to provide increased photographic coupling activity and improved contrast as compared with the couplers of the known type by virtue of the addition of a phenyl group, especially a low pKa phenyl group at a predetermined orientation relative to the benzimidazole coupler.

According therefore to the present invention there is provided a pyrazolo[1,5-a]benzimidazole compound of the formula (I):

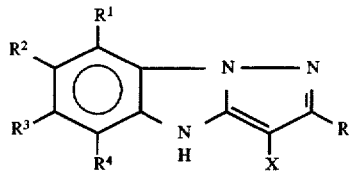

(I)

wherein R is H or a substituted or unsubstituted alkoxy, anilino, aryl or amide group $R^1$ to $R^4$ are selected from H, substituted or unsubstituted alkoxy, anilino, aryl, alkyl or amido groups, and X is H or a coupling-off group;

characterised in that said compound is linked via any of the moieties R to $R^4$ or X to the compound of the formula (II)

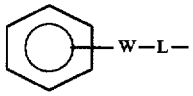

(II)

wherein W is an electron withdrawing group, and L is a linking group to any of the moeities R to $R^4$ or X.

The linking group to the compound of the formula (II) is preferably via X, R, or $R^3$. The group L may include a moiety of the formula

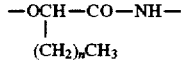

(IV)

wherein n is 9, for example, and said group L preferably further containing a substituted or unsubstituted aryl group.

The group W preferably includes a moiety of the formula

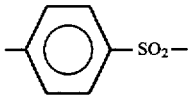

(V)

In a preferred form of the invention compound II given above is a low pKa phenyl group of the formula:

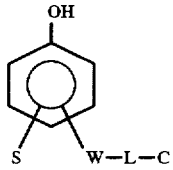

(III)

wherein S is optional and represents a substituent and wherein C represents the coupler resedue to which L is bonded. In a preferred form of the invention of this latter type $R^1$, $R^2$ and $R^3$ are preferably H, R is alkoxy and the compound II is linked via the $R^3$ moiety.

In a further preferred form of the invention X may be halo or a carboxyethylthio group.

Specific compounds useful in the performance of the present invention are selected from any one or more of the following:

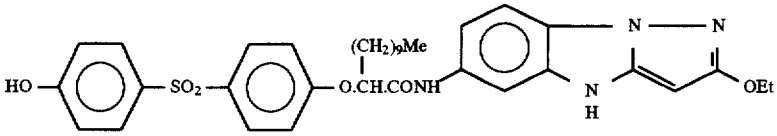

(1)

(1) N-(2-ethoxy-pyrazolo-4H-benzimidazole-6-yl)-2-[4-hydroxyphenylsulphonyl)phenoxy]dodecylamide.

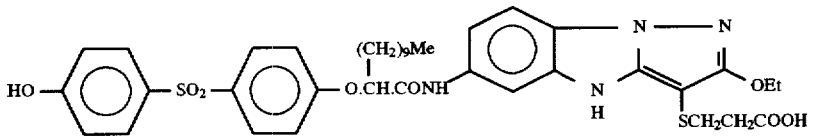

(2)

(2) N-[2-ethoxy-3-(2-carboxyethylthio)-pyrazolo-4H-benzimidazole-6-yl]-2-[4-(4-hydroxyphenylsulphonyl)-phenoxy]dodecylamide.

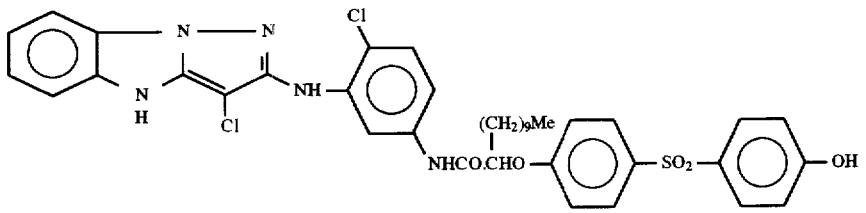

(3)

(3) N-[3-(4-H-3-chloro-pyrazolo[1,5-1]benzimidazole-z-ylamino)-4-chlorophenyl]-2-[4-(4-hydroxyphenylsulphonyl)phenoxy]dodecanamide.

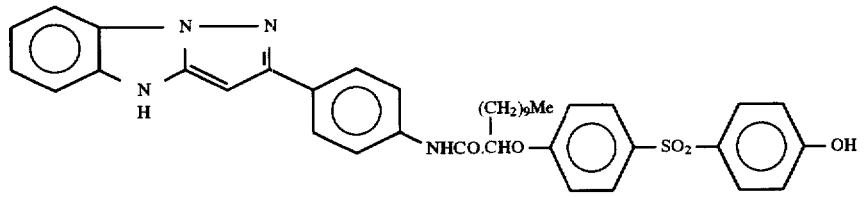

(4)

(4) N-[4-(4-H-pyrazolo[1,5-a]benzimidazole-2-yl)phenyl]-2-[4-(4-hydroxy phenyl sulphonyl)phenoxy) dodecanamide.

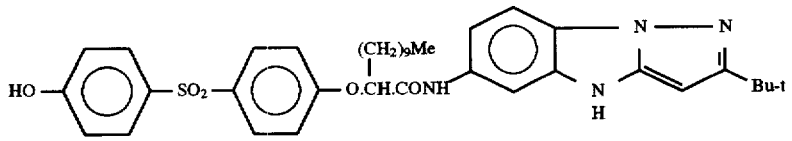

(5)

(5) N-(2-butyl-pyrazolo-4H-benzimidazol-6-yl)-2-[4-(4-hydroxyphenyl sulphonyl)-phenoxy]dodecylamide.

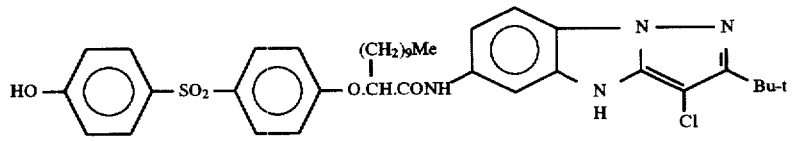

(6)

(6) N-(2-butyl-3-chloro-pyrazolo-4H-benzimidazol-6-yl)-2-[4-(4-hydroxyphenyl sulphonyl)-phenoxy]dodecylamide.

The compounds of the present invention are particularly useful as magenta and cyan dye couplers for use in colour silver halide imaging systems where the dyes are formed by oxidative coupling within the photographic layer of a photographic element.

The photographic element can be a single colour element or a multicolour element. In a multicolour element, the magenta dye-forming coupler combinations of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively. According to the present invention at least one of these magenta dye-forming couplers would be in combination with a substituted phenol. The element can contain additional layers, such as filter and barrier layers.

In the following discussion of suitable materials for use in the emulsions and elements of this invention, reference will be made to Research Disclosure, December 1989, Item 308119, published by Industrial Opportunities Ltd., The Old Harbourmaster's, 8 North Street, Emsworth, Hants PO10 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the pyrazolone coupler combinations of this invention, the elements of the invention can include additional couplers as described in Research Disclosure Section VII, paragraphs D, E, F and G and the publications cited therein. The coupler combinations of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardners (see Research Disclosure Section X), plasticisers and lubricants (see Research Disclosure Section XII), antistatic agents (see Research Disclosure Section XIII), mating agents (see Research Disclosure Section XVI), and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)ethylaniline sulphate hydrate, 4-amino-3-methyl-N-ethyl-N-β-hydroethylaniline sulphate, 4-amino-3-β-(methanesulphonamido)ethyl-N,N-diethylaniline hydrochloride and 4-amino-N-ethyl-N-(2-methoxyethyl)-m-toluidine di-p-toluene sulphonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The invention will now be described by way of illustration only with reference to the following Examples.

EXAMPLE 1

Preparation of 2-Dodecyloxy-4-H-pyrazolo[1,5-a]benzimidazole (Coupler C1)

(a) O-Dodecyl-2-ethoxycarbonylacetimidate hydrochloride

Ethyl cyanoacetate (84.8g, 0.75 mole) and dodecyl alcohol (140 g, 0.75 mole) were dissolved in diethyl ether (120 ml). The stirred solution was saturated with HCl gas over a period of 1.5 hrs whilst being cooled in an ice bath. A further quantity of ether was added (300 ml), and the clear solution was stirred in an ice/salt bath for 1.5 hrs to precipitate the product. The mixture was stood in a cool room at 4° C. overnight, the crystalline solid filtered off, washed with a little ether, and dried under vacuum at 20° C., (yield=30.27 g.). The mass spectrum and elemental analysis results were consistent with the product being O-dodecyl-2-dodecyloxycarbonylacetimidate hydrochloride. The filtrate was placed in the fridge overnight, and this precipitated a further quantity of crystals. These were filtered off, washed with ether, and dried under vacuum at 20° C. Analysis was consistent with the desired product, O-Dodecyl-2-ethoxycarbonylacetimidate hydrochloride. The yield was 100.87 g, 40%.

Analaysis; calculated for $C_{14}H_{34}ClNO_3$; Calc: C 60.8%, H 10.2%, Cl 10.6%, N 4.2%, Found: C 60.3%, H 10.1% Cl 10.0%, N 4.1%.

(b) 3-Dodecyloxy-1-(2-nitrophenyl)pyrazol-5-one

2-Nitrophenylhydrazine (16.1 g, 105 mmole) was stirred in tertiary butyl alcohol (150 mls), and O-dodecyl-2-ethoxycarbonylacetimidate hydrochloride (35.0 g, 105 mmole) added with stirring. After 1.5 hr at room temperature, the formation of the intermediate hydrazone was complete. The reaction mixture was brought to reflux temperature, a solution of sodium hydroxide in water (140 ml, 0.2 g/ml) was added, and heating was continued for a further 10 min. The solution was allowed to cool and was drowned in dilute (5%) hydrochloric acid (21). The crude product was extracted into ethyl acetate, and the extracts were combined, dried with magnesium sulphate, and concentrated by rotary evaporation. The product was purified by column chromatography on silica gel, using an ethyl acetate/60°–80° C. petrol mixture (1:2) as eluant. The solid was further purified by recrystallisation from ethyl acetate: 60°–80° C. petrol (1:9) to give the product, 3-dodecyloxy-1-(2-nitrophenyl)pyrazol-5-one, as a brown solid. The yield was 8.0 g, 20%.

Analysis; Calculated for $C_{21}H_{31}N_3O_4$; Calc: C 64.8%, H 8.0%, N 10.8%, Found: C 65.2%, H 8.3%, N 10.5%.

(c) 2-Dodecyloxy-4-H-pyrazolo[1,5-a]benzimidazole

3-Dodecyloxy-1-(o-nitrophenyl)pyrazol-5-one (8.0 g, 20.54 mmole) was dissolved in acetic acid (200 ml), and 10% palladium on charcoal (0.8 g) in acetic acid (10 ml) added. The reaction mixture was hydrogenated under pressure for a period of 1.5 hrs. The catalyst was filtered from the mixture to leave a solution of the 3-alkoxy-1-(o-aminophenyl)pyrazol-5-one in acetic acid. Cyclisation to (1) was effected by heating the acetic acid solution under reflux for fifteen minutes. The solution was allowed to cool, and the solvent was removed by rotary evaporation to give the crude product as a dark orange solid. Recrystallisation, once from acetonitrile, and three times from an ethyl acetate/60°–80° C. petrol mixture (1:2), gave pure 2-dodecyloxy-4-H-pyrazolo[1,5-a]benzimidazole. The yield was 3.97, 57%.

Analysis; Calculated for $C_{21}H_{31}N_3O$; Calc: C 73.9%, H 9.2%, N 12.3%, Found: C 73.7%, H 9.2%, N 12.2%.

EXAMPLE 2

Preparation of 3-(2-Dodecyloxy-4-H-pyrazolo[1,5-a]benzimidazol-3-ylthio)propionic acid. (Coupler C2)

Coupler (C1) (3.91 g, 11.45 mmole) and 3-mercaptopropionic acid (1.22 g, 11.45 mmole) were stirred in dimethylformamide (60 ml), and a solution of bromine (2.93 g, 18.3 mmole) in dimethyl formamide (10 ml) was added dropwise until about a quarter of the bromine solution remained. The reaction mixture was then stirred at room temperature for two hours. The remaining bromine solution was then added in a dropwise manner, and the mixture was allowed to stir for a further thirty minutes. The solution was drowned in dilute hydrochloric acid (600 ml), and the crude product was extracted into ethyl acetate. The extracts were combined, dried with magnesium sulphate, and concentrated by rotary evaporation to give a brown oil. The crude product was purified by column chromatography on silica gel, using an ethyl acetate/60°–80° C. petrol mixture (1:1) as eluant. The product was further purified by recrystallisation from an ethyl acetate/petrol mixture, to give pure 3-(2-dodecyloxy-4-H-pyrazolo[1,5-a]benzimidazol-3-ylthio)-propionic acid. The yield was 3.77 g, 74%.

Analysis; Calculated for $C_{24}H_{35}N_3O_3S$; Calc: C 64.7%, H 7.9%, N 9.4%, S 7.2%, Found: C 64.8%, H 7.9%, N 9.3%, S 6.8%.

EXAMPLE 3

Preparation of N-(2-Ethoxy-pyrazolo-4H-benzimidazol-6-yl)-2-[4-(4-hydroxyphenylsulphonyl)phenoxy]dodecylamide (Coupler 1)

(a) N-(4-Fluoro-3-nitrophenyl)-2-[4-(4-hydroxyphenylsulphonyl)phenoxy]dodecylamide 2-[4-(4-acetoxyphenylsulphonyl)phenoxy]dodecanoic acid (98.0 g, 0.2 mole) was refluxed with thionyl chloride (120 ml) for 45 mins. The excess thionyl chloride was removed by rotary evaporation, 60°–80° C. petrol (50 ml) added and the solvent again removed. This last step was repeated twice more to remove the last traces of thionyl chloride. The acid chloride was obtained as a clear oil in quantitative yield (102.7 g).

4-Fluoro-3-nitroaniline (31.22 g, 0.2mole) was dissolved in tetrahydrofuran (600 ml) and pyridine (200 ml) and a solution of the above acid chloride (102.7 g, 0.2mole) in tetrahydrofuran (300 ml) added over a period of 1 hr. The mixture was stirred at room temperature for 2 hr and then poured into dilute (5%) hydrochloric acid solution (81). The gummy solid was extracted into ethyl acetate, washed with water and dried over magnesium sulphate. Removal of the solvent gave the crude acylated product as an oil which was dissolved in ethanol (500 ml) with warming, cooled to 20° C. and stirred while a solution of sodium hydroxide (350 ml, 4M) was added. The mixture was stirred for 1 hr, poured into dilute (5%) hydrochloric acid (41) and the gum obtained extracted into ethyl acetate. The extract was washed with water, dried over magnesium sulphate and the solvent removed by rotary evaporation. The residue was crystallised from ethyl acetate and 60°–80° C. petrol to give N-(4-fluoro-3-nitrophenyl)-2-[4-(4-hydroxyphenylsulphonyl)phenoxy]dodecylamide as a pale yellow solid, 86.8 g, 74%.

Analysis; calculated for $C_{30}H_{35}FN_2O_7S$; Calc: C 61.4%, H 6.0%, N 4.8%, S 5.5%, Found: C 61.4%, H 6.0%, N 4.6%, S 5.5%.

(b) N-(4-Hydrazino-3-nitrophenyl)2-[4-(4-hydroxyphenylsulphonyl)phenoxy]dodecylamide N-(4-Fluoro-3-nitrophenyl)-2-[4-(4-hydroxyphenylsulphonyl)phenoxy]dodecylamide (86.0 g, 147.0 mmole) was dissolved in dimethyl sulphoxide (500 ml), and hydrazine monohydrate (17.8 g, 355 mmole) was added in a dropwise fashion whilst keeping the temperature below 40° C. The reaction mixture was stirred for 1.5 hr at room temperature, and was then drowned in an ice/brine mixture (610). The red solid obtained was filtered off and dried at room temperature. The product, N-(4-Hydrazino-3-nitrophenyl)2-[4-(4-hydroxyphenylsulphonyl)phenoxy]dodecylamide, was used in this crude form without any further purification.

(c) N-[3-Nitro-4-(3-ethoxy-5-pyrazolon-1-yl)phenyl]-2-[4-(4-hydroxyphenylsulphonyl)phenoxy]dodecylamide N-[3-nitro-4-(3-ethoxy-5-pyrazolon-1-yl)phenyl]-2-[4-(4-hydroxyphenylsulphonyl)phenoxy]dodecylamide was prepared by the method in (1b) from N-(4-hydrazino-3-nitrophenyl)-2-[4-(4-hydroxphenylsulphonyl)phenoxy]dodecylamide (2b) and O-ethyl 2-ethoxycarbonylacetimidate hydrochloride (prepared from ethyl cyanoacetate and ethanol as in method (1a)). The crude product was partially purified by column chromatography using 63-200 mesh silica gel and ethyl acetate/60°–80° C. petrol (1:1) as the eluent. The yield of N-[3-nitro-4-(3-ethoxy-5-pyrazolon-1-yl)phenyl]2-[4-(4-hydroxyphenylsulphonyl)phenoxy]-dodecylamide was 29% over the two stages (2a) to (2c).

Analysis; Calculated for $C_{35}H_{42}N_4O_9S$; Calc: C 60.5%, H 6.1%, N 8.1%, S 4.6%, Found: C 59.2%, H 6.0%, N 7.5%, S 5.0%.

(d) N-(2-Ethoxypyrazolo-4H-benzimidazol-6-yl)-2-[4-(4-hydroxyphenylsulphonyl)phenoxy]dodecylamide (Coupler 1)

N-(2-Ethoxypyrazolo-4H-benzimidazol-6-yl)-2-[4-(4-hydroxyphenylsulphonyl)phenoxy]dodecylamide was prepared from (2c) using the method indicated in (1c). The crude product was purified by column chromatography using 63-200 mesh silica gel and ethyl acetate/60°–80° C. petrol (2:1) as the eluent, followed by an acetonitrile slurry. Coupler 1 was obtained as a cream solid 8.15 g, 30% yield.

Analysis; Calculated for $C_{35}H_{42}N_4O_6S$; Calc: C 65.0%, H 6.6%, N 8.7%, S 5.0%, Found: C 64.6%, H 6.6%, N 8.3%, S 5.3%.

EXAMPLE 4

(e) N-(2-Ethoxy-3-(2-carboxyethylthio)-pyrazolo-4H-benzimidazol-6-yl)-2-[4-(4-hydroxyphenylsulphonyl)phenoxy]dodecylamide (Coupler 2)

Coupler (2) (5.17 g, 8.0 mmole) and 3-mercaptopropionic acid (0.85 g, 8.0 mmole) were stirred in dimethylformamide (60 ml) and a solution of bromine (2.05 g, 12.8 mmole) in dimethylformamide (10 ml) added dropwise until ¼ of the bromine solution remained. The mixture was stirred 2 hrs at room temperature, the remaining bromine solution added dropwise, and stirring continued for 30 mins. The mixture was poured into dilute (5%) hydrochloric acid (1.21) and the solid filtered off, washed and dried in air. The product was purified by column chromatography using 63-200 mesh silica gel as the absorbant. Ethyl acetate was used to elute the major impurities and the product was eluted with 2% acetic acid in ethyl acetate. Further purification was achieved by a hot ethanol slurry to give pure Coupler 2 as a white solid, 2.8 g, 47% yield.

Analysis; Calculated for $C_{38}H_{46}N_4O_8S_2$; Calc: C 60.8%, H 6.2%, N 7.5%, S 8.5%, Found: C 60.5%, H 6.0%, N 7.6%, S 8.6%.

EXAMPLE 5

Preparation of N-Dodecyl-4-chloro-3-(4-H-3-chloropyrazolo[1,5-a]benzimidazol-2-ylamino benzenesulphonamide (Coupler 3)

(a) 1-(2-Nitrophenyl)-3-[2-chloro-5-(N-dodecylsulphonamido)anilino]-5-pyrazolone 2-Chloro-5-(N-Dodecylsulphonamido)aniline (30 g, 80 mmoles) was dissolved in a warm mixture (60° C.) of methanol (100 ml) and toluene (150 ml) then o-ethoxy-2-ethoxycarbonylacetimidate hydrochloride (15.64 g, 80 mmoles) was added portionwise as a solid. The resulting solution was stirred for five hours at 60° C. during which time a white precipitate formed. The mixture was allowed to cool to ca.30° C. and more toluene (ca. 100 ml) was added before the precipitate was filtered and washed with toluene. The filtrate was concentrated under reduced pressure to leave a brown oil which was dissolved in glacial acetic acid (170 ml) then o-nitrophenyl hydrazine (12.24 g, 80 mmoles) was added portionwise. The resulting red coloured mixture was heated to ca. 60° C. for 18 hours.

After this time the solvents were removed under reduced pressure to leave a viscous red oil. This was dissolved in methanol (250 ml) then to this was added a freshly prepared solution of sodium (log, 435 mmoles) in methanol (250 ml). The resulting purple coloured mixture was warmed gently on the steam bath for ca. two hours before being poured into dilute hydrochloric acid (41). A dark yellow solid precipitated and was extracted into ethyl acetate. The organic layer was washed with water then separated before being dried (magnesium sulphate), filtered and concentrated to leave a brown gum. Pure 1-(2-nitrophenyl)-3-[2-chloro-5-(N-dodecylsulphonamido)anilino]-5-pyrazolone (16.73 g, 36%) was obtained as a waxy yellow solid from this crude material by column chromatography using silica gel (63-200 mesh) as solid phase and ethyl acetate and 60°–80° C. petroleum, in the ratio of 30:70, as eluent.

The product exhibited a satisfactory proton NMR spectrum and was used without further characterisation.

(b) 1-(2-Aminophenyl)-3-[2-chloro-5-(N-dodecylsulphonamido)anilino]-5-pyrazolone The o-nitro pyrazolone (5a) (16.73 g, 29 mmoles) was dissolved in THF (500 ml) and an unweighed amount of Raney Nickel catalyst added. The mixture was hydrogenated under ca. 35 atmospheres of hydrogen at ambient temperature for 3 hours. After this time the catalyst was filtered and the solvents removed under reduced pressure to leave a grey-coloured solid (15.37 g) which was pure by TLC.

Analysis; calculated for $C_{27}H_{38}ClN_5O_3S$; Calc: C 59.2%, H 7.0%, Cl 6.5%, N 12.8%, S 5.85%, Found: C 59.0%, H 7.1%, Cl 6.2%, N 12.15%, S 5.5%.

(c) N-Dodecyl-4-chloro-3-(4-H-pyrazolo[1,5-a]benzimidazol-2-ylamino)bezenesulphonamide The o-amino pyrazolone (5b) (15.37 g, 28 mmoles) was dissolved in refluxing isopropanol (150 ml) and concentrated hydrochloric acid (12 ml) was added. Heating was continued for a further 3.5 hours. The solution was allowed to cool before being poured onto a solution of sodium hydrogen carbonate (7.5 g) in water (41) to precipitate a sticky brown solid. This was extracted into ethyl acetate then the organic layer was separated, dried with magnesium sulphate, filtered and concentrated to give the crude product. Pure N-dodecyl-4-chloro-3-(4-H-pyrazolo[1,5-a]benzimidazol-2-ylamino)benzenesulphonamide (11.39 g, 77%) was obtained by column chromatography using silica gel (63-200 mesh) as solid support and ethyl acetate and 60°–80° C. petroleum in the ratio of 30:70 as eluent.

Analysis; calculated for $C_{27}H_{35}ClN_5O_2$; Calc: C 61.2%, H 6.8%, Cl 6.7%, N 13.2% S 6.05%, Found: C 61.5%, H 7.2%, Cl 6.05%, N 13.0%, S 5.7%.

(d) N-Dodecyl-4-chloro-3-(4-H-3-chloro-pyrazolo [1,5-a]benzimidazol-2-ylamino)benzenesulphonamide (Coupler C3)

N-Dodecyl-4-chloro-3-(4-H-pyrazolo[1,5-a]benzimidazol-2-ylamino)benzenesulphonamide (5.3 g, 10 mmoles) was dissolved in chloroform (200 ml) and the solution stirred at room temperature. N-chloro succinimide (1.34 g, 10 mmoles) was then slowly added in a portionwise manner. On completion of the addition the mixture was stirred for ca. 10 minutes then poured onto water. The organic layer was separated, dried with magnesium sulphate, filtered and concentrated to give a light brown solid. Recrystallisation from acetonitrile gave pure Coupler C3 as a brown solid, 3.73 g, 66%.

Analysis; calculated for $C_{27}H_{34}Cl_2N_5O_2$; Calc: C 57.4%, H 6.3%, Cl 12.6%, N 12.4%, S 5.7%, Found: C 57.7%, H 6.2%, Cl 12.35%, N 12.3%, S 5.7%.

EXAMPLE 6

Preparation of N-[3-(4-H-3-chloro-pyrazolo[1,5-a]benzimidazol-2-ylamino)-4-chlorophenyl]-2-[4-(4-hydroxyphenylsulphonyl)phenoxy]dodecanamide (Coupler 3)

(a) N-{3-[1-(2-nitrophenyl)-5-pyrazolone-3-ylamino]-4-chlorophenyl}-2-[4-(4-hydroxyphenylsulphonyl)phenoxy]dodecanamide N-{3-[1-(2-nitrophenyl)-5-pyrazolone-3-yl]-4-chlorophenyl}-2-(4-(4-hydroxyphenylsulphonyl)phenoxy]dodecanamide was prepared in the same manner as example 5(a) using N-(4-chloro-3-aminophenyl-2-[4-(4-acetoxyphenylsulphonyl)phenoxy]dodecanamide as the aniline component. The product was obtained as a yellow solid after crystallisation from methanol in 29% yield.

Analysis; Calculated for $C_{39}H_{42}ClN_5O_8S$; Calc: C 60.3%, H 5.45%, Cl 4.6%, N 9.0%, Found: C 58.4%, H 5.3%, Cl 4.8%, N 8.6%.

(b) N-{3-[1-(2-aminophenyl)-5-pyrazolone-3-ylamino]-4-chlorophenyl}-2-[4-(4-hydroxyphenylsulphonyl)phenoxy]dodecanamide N-{3-[1-(2-aminophenyl)-5-pyrazolone-3-yl]-4-chlorophenyl}-2-[4-(4-hydroxyphenylsulphonyl)phenoxy]dodecanamide was prepared in the same manner as example 5(b). The product was obtained as an off-white solid after trituration with ethyl acetate and 60°–80° C. petrol (1:9) in 95% yield:

Analysis; Calculated for $C_{39}H_{44}ClN_5O_7S$; Calc: C 62.8%, H 5.9%, Cl 4.75%, N 9.4%, S 4.3%, Found: C 62.2%, H 6.0%, Cl 4.6%, N 9.5%, S 4.2%.

(c) N-[3-(4-H-pyrazolo[1,5-a]benzimidazol-2-ylamino)-4-chlorophenyl]-2-[4-(4-hydroxyphenylsulphonyl)phenoxy]-dodecanamide N-[3-(4-H-pyrazolo[1,5-a]benzimidazol-2-ylamino)-4-chlorophenyl]-2-[4-(4-hydroxyphenylsulphonyl)phenoxy]dodecanamide was prepared in the same manner as example 5(c). The product was obtained as an off-white solid in 65% yield after purification by column chromatography using silica-gel (63-200 mesh) as the solid support and ethyl acetate and 60°–80° C. petroleum, in the ratio of 1:1, as eluent.

Analysis; Calculated for $C_{39}H_{42}ClN_5O_6S$; Calc: C 64.3%, H 5.8%, Cl 4.9%, N 9.6%, S 4.4%, Found: C 64.0%, H 6.0%, Cl 4.7%, N 8.8%, S 4.1%.

(d) N-[3-(4-H-3-chloro-pyrazolo[1,5-a]benzimidazol-2-ylamino)-4-chlorophenyl]-2-[4-(4-hydroxyphenyl sulphonyl)phenoxy]dodecanamide. (Coupler 3)

N-[3-(4-H-3-chloro-pyrazolo[1,5-a]benzimidazol-2-ylamino)-4-chlorophenyl]-2-[4-(4-hydroxyphenylsulphonyl)phenoxy]dodecanamide was prepared in the same manner as example 5 (d). The product was obtained as an off-white in 57% yield after recrystallisation from acetonitrile.

Analysis; Calculated for $C_{39}H_{41}Cl_2N_5O_6S$; Calc: C 61.4%, H 5.4%, Cl 9.3%, N 9.2%, S 4.2%, Found: C 61.0%, H 5.4%, Cl 9.4%, N 9.1%, S 4.1%.

EXAMPLE 7

Preparation of N-[4-(4-H-pyrazolo[1,5-a]benzimidazol-2-yl)phenyl]-2-[4-(4-hydroxyphenylsulphonyl)phenoxy]dodecanamide. (Coupler 4)

(a) 4-H-1-(2-nitrophenyl)-3-(4-nitrophenyl)-5-pyrazolone

2-Nitrophenylhydrazine (32.9 g, 215 mmole) and ethyl 4-nitrobenzoyl acetate (55.95 g, 236 mmole) were stirred at room temperature in acetic acid (500 ml) for 30 mins to form the corresponding hydrazone. The solution was then refluxed for 6 hrs to effect the cyclisation, cooled and left to stand overnight. The crystalline product was filtered off and recrystallised from ethyl acetate and 60°–80 ° C. petrol to give pure 4-H-1-(2-nitrophenyl)-3-(4-nitrophenyl)-5-pyrazolone, 27.7 g, 40%.

(b) 4-H-2-(4-Aminophenyl)pyrazolo[1,5-a]benzimidazole

4-H-1-(2-nitrophenyl)-3-(4-nitrophenyl)-5-pyrazolone (7a) (27.7 g, 85 mmole) was suspended in acetic acid (450 ml) and 10% palladium on charcoal added (3 g). The mixture was hydrogenated under pressure (15 ats) for 2 hrs. TLC analysis (EtOAc) indicated that the diamine intermediate had been formed and no starting material remained. The solution was filtered through kieselghur to remove catalyst and the filtrate heated under reflux for 20 mins. The solution was cooled and poured into stirred water (3.5l). The solid which formed was filtered off, washed and dried. This was the acetylated product 4-H-2-(4-acetylaminophenyl) pyrazolo[1,5-a]benzimidazole, 7.18 g, 29%. The pH of the aqueous filtrate was adjusted to 7 by the addition of 0.88 ammonia which caused the product, 4-H-2-(4-aminophenyl) pyrazolo[1,5-a]benzimidazole, to be precipitated as a white solid, which was filtered off, washed and dried, 9.32 g, 44%.

Analysis; calculated for $C_{15}H_{12}N_4$; Calc: C 72.6%, H 4.9%, N 22.6%, Found: C 72.6%, H 5.0%, N 22.8%.

(c) N-[4-(4-H-pyrazolo[1,5-a]benzimidazol-2-yl)phenyl]-2-[4-(4-hydroxyphenylsulphonyl)phenoxy)dodecanamide.) (Coupler 4)

2-[4-(4-acetoxyphenylsulphonyl)phenoxy]dodecanoyl chloride (9.56 g, 18.8 mmole), prepared as in example (2a), was dissolved in dry tetrahydrofuran (30 ml) and added dropwise over 30 mins to a stirred solution of 4-H-2-(4-aminophenyl)pyrazolo[1,5-a]benzimidazole (7b) (4.66 g, 18.8 mmole) in dry tetrahydrofuran (60 ml) and pyridine (20 ml). The mixture was stirred for 2 hrs at room temperature and then poured into stirred dilute (1N) hydrochloric acid (1l). The solid was filtered off and the damp material suspended in ethanol (200 ml). Sodium hydroxide solution (4N, 35 ml) was added and the mixture stirred for 1 hr at room temperature. The alcoholic solution was drowned in dilute acetic acid (1N) and the precipitated product filtered off washed, dried and chromatographed on silica gel using 2:1 ethyl acetate: 60–80 petroleum ether as eluent. The yield of pure Coupler 4 (obtained as the dihydrate) was 8.2 g, 64%.

Analysis; calculated for $C_{39}H_{42}N_4O_5S.2H_2O$; Calc: C 67.0%, H 6.6%, N 8.0%, S 4.6%, Found: C 67.4%, H 6.2%, N 7.7%, S 5.0%.

EXAMPLE 8

Preparation of N-[4-(4-H-pyrazolo[1,5-a]benzimidazol-2-yl)phenyl]-2-(3-t-butyl-4-hydroxyphenozy)tetradecanamide (Coupler C4)

Coupler C4 was prepared as for coupler 4 using 2-(3-t-butyl-4-acetoxyphenoxy)tetradecanoyl chloride and the amine (7b). The product was recrystallised from acetonitrile to give 55% yield of pure product.

Analyis calculated for $C_{39}H_{50}N_4O_3$; Calc: C 75.2%, H 8.1%, N 9.0%, Found: C 75.0%, H 7.9%, N 9.1%.

EXAMPLE 9

Comparison Couplers

The following compounds are used as comparisons to illustrate the improvement in activity achieved with couplers containing a low pKa phenolic group. (C1is the comparison for coupler 1 and C2 for coupler 2 etc)

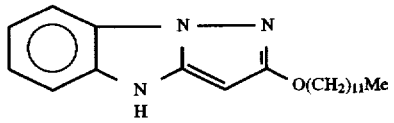

(C1)

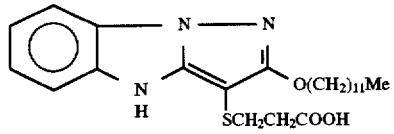

(C2)

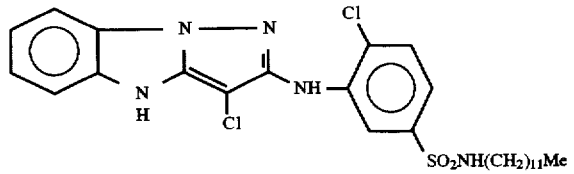

(C3)

-continued

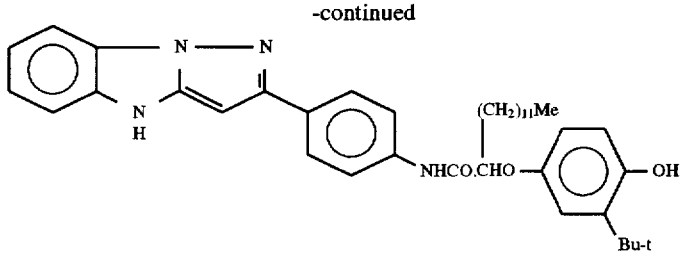

(C4)

Each of the foregoing comparison couplers was compared in standardized tests with the designated compounds according to the invention. The results are given in Table 1 below.

TABLE 1

Comparison of Coupler Activity (as measured by Dmax and γ)

| Coupler | | Dmax | Dmin | γ | λmax/nm | HBW/nm |
|---|---|---|---|---|---|---|
| (1) | (Invention) | 0.89 | 0.12 | 0.69 | 558.0 | 115.0 |
| (C1) | (Comparison) | 0.12 | 0.12 | * | * | * |
| (2) | (Invention) | 2.98 | 0.18 | 3.52 | 555.5 | 113.0 |
| (C2) | (Comparison) | 2.10 | 0.21 | 2.78 | 546.5 | 107.5 |
| (3) | (Invention) | 2.82 | 0.15 | 2.40 | 549.0 | 127.5 |
| (C3) | (Comparison) | 1.93 | 0.16 | 1.65 | 542.0 | 122.0 |
| (4) | (Invention) | 0.82 | 0.13 | 0.50 | 589.0 | 116.5 |
| (C4) | (Comparison) | 0.22 | 0.13 | 0.06 | * | * |

Note. Inventive couplers show significantly higher Dmax figures; (i.e. maximum dye density formed on development) while also showing higher contrast figures.

The invention relates therefore to novel pyrazolo[1,5-a] benzimidazole couplers particularly those containing a low pKa phenolic substituent and to photographic systems and photographic elements containing the same.

We claim:

1. A photographic element comprising a light-sensitive photographic silver halide emulsion layer having associated therewith a coupler compound of formula (III)

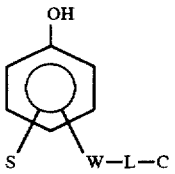

(III)

wherein

W is an electron withdrawing group having the formula (V):

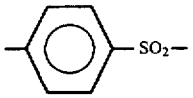

(V)

wherein the phenyl ring of (V) is linked to L;

L is a linking group that links to any one of the moieties $R^1$ to $R^4$ of the residue of the coupler (C) which has the formula:

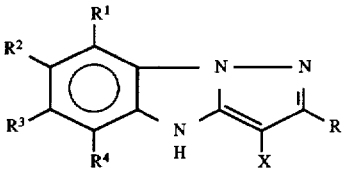

(I)

wherein

R is selected from the group consisting of H, and substituted or unsubstituted alkoxy, anilino, aryl, and amide groups;

$R^1$ to $R^4$ are independently selected from the group consisting of alkyl and the selection group for R;

X is H or a coupling-off group and S is an optional substituent.

2. The element of claim 1 wherein the link to the coupler is via $R^3$.

3. The element of claim 1 wherein X is halo or carboxyethylthio group.

4. The element according to claim 1 wherein the coupler compound is selected from the group consisting of:

(1) N-(2-ethoxy-pyrazolo-4H-benzimidazole-6-yl)-2-[4-hydroxyphenylsulphonyl)phenoxy]dodecylamide;

(2) N-[2-ethoxy-3-(2-carboxyethylthio)-pyrazolo-4H-benzimidazole-6-yl]-2-[4-(4-hydroxyphenylsulphonyl)-phenoxy]dodecylamide;

(5) N-(2-butyl-pyrazolo-4H-benzimidazole-6-yl)-2-[4-(4-hydroxyphenyl sulphonyl)-phenoxy]dodecylamide, and (6) N-(2-butyl-3-chloro-pyrazolo-4H-benzimidazole-6-yl)-2-[4-(4-hydroxyphenyl sulphonyl)-phenoxy] dodecylamide.

5. The element according to claim 1 wherein the coupler compound is selected from the group consisting of:

(1) N-(2-ethoxy-pyrazolo-4H-benzimidazole-6-yl)-2-[4-hydroxyphenylsulphonyl)phenoxy]dodecylamide; and (2) N-[2-ethoxy-3-(2-carboxyethylthio)-pyrazolo-4H-benzimidazole-6-yl]-2-[4-(4-hydroxyphenylsulphonyl) phenoxy]dodecylamide.

6. The element of claim 1 wherein R is an alkoxy group and $R^1$ to $R^4$ are each a hydrogen or an amide substituent.

7. A photographic element comprising a light-sensitive photographic silver halide emulsion layer having associated therewith a coupler compound of the formula:

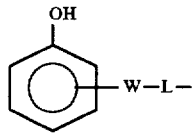

wherein

W is an electron withdrawing group having the formula (V):

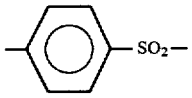

(V)

wherein the phenyl ring of formula (V) is linked to L;

L is a linking group that links to any one of the moieties $R^1$ to $R^4$ of the residue of a coupler which has the formula:

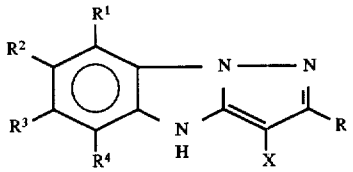

(I)

wherein

R is selected from the group consisting of H, and substituted or unsubstituted alkoxy, anilino, aryl, and amide groups;

$R^1$ to $R^4$ are independently selected from the group consisting of alkyl and the selection group for R;

X is H or a coupling-off group.

8. The element according to claim 7 wherein the link (L) to the coupler is via $R^3$.

9. The element according to claim 7 wherein R is a substituted or unsubstituted alkoxy group, and $R^1$ to $R^4$ are each a hydrogen or an amide substituent.

10. The element of claim 7 wherein X is halo or carboxyethylthio group.

* * * * *